US005375311A

United States Patent [19]

Nabulon

[11] Patent Number: 5,375,311

[45] Date of Patent: Dec. 27, 1994

[54] APPARATUS FOR THE CONTINUOUS CRIMPING OF THERMOPLASTIC THREADS

[75] Inventor: Werner Nabulon, Rüdlingen, Switzerland

[73] Assignee: Maschinenfabrik Rieter AG, Winterthur, Switzerland

[21] Appl. No.: 63,301

[22] Filed: May 19, 1993

[30] Foreign Application Priority Data

May 20, 1992 [CH] Switzerland ..... 01614/92

[51] Int. Cl.[5] ..... D02G 1/12

[52] U.S. Cl. ..... 28/256; 28/247

[58] Field of Search ..... 28/221, 250, 254, 255, 28/256, 257, 258, 262, 263, 264, 247

[56] References Cited

U.S. PATENT DOCUMENTS

| | | | |
|---|---|---|---|
| 3,363,041 | 1/1968 | Shichman . | |
| 3,899,811 | 8/1975 | Bauch | 28/257 |
| 4,462,143 | 7/1984 | Oswald et al. | 28/257 |
| 4,519,116 | 5/1985 | Aberle et al. | 28/257 |
| 4,877,570 | 10/1989 | Nabulon . | |
| 4,930,198 | 6/1990 | Li et al. | 28/257 |
| 4,974,302 | 12/1990 | Nabulon . | |

FOREIGN PATENT DOCUMENTS

| | | | |
|---|---|---|---|
| 0310890 | 12/1991 | European Pat. Off. . | |
| 4531266 | 10/1970 | Japan | 28/257 |
| 4531267 | 10/1970 | Japan | 28/257 |
| 4918493 | 5/1974 | Japan | 28/257 |
| 0034563 | 3/1980 | Japan | 28/257 |
| 1198035 | 7/1970 | United Kingdom | 28/257 |

*Primary Examiner*—Clifford D. Crowder
*Assistant Examiner*—Larry D. Worrell, Jr.
*Attorney, Agent, or Firm*—Sandler, Greenblum & Bernstein

[57] ABSTRACT

An apparatus for the continuous crimping of thermoplastic threads has at least one crimping nozzle with a feed channel and a nozzle orifice and at least one pair of lateral guide means, e.g. needle rows, arranged around the circumference of a plug feed roller wherein, in an apparatus in which several threads are crimped in parallel, several axially spaced guide means pairs are used on the same feed roller, and in order to prevent disturbing transverse flows so as to render the aerodynamic conditions uniform during plug formation in the vicinity of the crimping nozzle orifice and for easy handling the plug feed roller, the guide means are axially protected against one another and against the outside by protective rings which have an identical or larger external diameter than the pair of guide means.

23 Claims, 3 Drawing Sheets

APPARATUS FOR THE CONTINUOUS CRIMPING OF THERMOPLASTIC THREADS

CROSS REFERENCE TO RELATED APPLICATIONS

This application claims the priority of Swiss Application No. 01 614/92-6, filed May 20, 1992, the disclosure of which is incorporated herein by reference in its entirety.

This application is also related to commonly assigned U.S. Pat. No. 4,877,570, issued Oct. 31, 1989 and U.S. Pat. No. 4,974,302, issued Dec. 4, 1990, the disclosures of which are incorporated in their entirety herein by reference.

BACKGROUND OF THE INVENTION

1. Field of the Invention

The invention is in the field of textile technology and relates to an apparatus, which is used for the continuous crimping of threads made from thermoplastic material.

2. Discussion of the Background of the Invention and Material Information

Apparatuses for the continuous crimping of threads made from thermoplastic material are e.g. described in European patent publication 310890, also assigned to the assignee of the present invention. The apparatuses described herein have a stationary crimping nozzle with a feed channel, as well as a nozzle orifice and a rotary plug feed roller. The crimping nozzle is positioned substantially tangentially to the plug feed roller in such a way that the nozzle orifice, and a guide fork fitted in the vicinity of said orifice, projects between two parallel, interrupted, lateral guide means passing around the circumference of the plug feed roller. The stuffer box is on the one hand bounded by the stationary parts of the guide fork and on the other by the lateral guide means rotating with the plug feed roller.

For crimping purposes the thread is conveyed, by means of a heated feed medium, under pressure through the feed channel and against the nozzle orifice and is simultaneously heated. Immediately outside the nozzle orifice the feed medium expands and the thread is accumulated in the stuffer box to form a plug, which is then guided by the lateral guide means and conveyed away on the plug feed roller. The thread speed in the feed channel is higher than the circumferential speed of the plug feed roller (plug speed). In order that the feed medium can expand in the vicinity of the nozzle orifice, the lateral guide means are shaped in an interrupted form. Rows of radially positioned needles have proven themselves to be particularly advantageous as lateral guide means.

In most applications, since a plurality of parallel. moving threads are produced, the plug feed roller has several pairs of lateral guide means for each plug which are parallel and spaced with respect to one another.

It has been determined that, in particular with rollers for several pairs of needle rows, transverse flows occur during operation (in the axial direction of the plug feed roller), which have a disadvantageous effect on plug formation. It has also been determined that such plug feed rollers, and in particular those with needle rows (needle rollers), are difficult to handle and are easily damaged during replacement, particularly in the heated state.

SUMMARY OF THE INVENTION

The purpose or object of the present invention is to provide an apparatus for the continuous crimping of thermoplastic threads, which eliminates the noted disadvantage pertaining to transverse flows. It is a further purpose or object of the present invention to eliminate the noted disadvantage pertaining to needle row damage during replacement while only involving minor modifications, i.e. to provide a continuous crimping apparatus for which the replacement and handling of the plug feed roller, particularly in the form of a needle roller, is simplified and more problem-free compared with prior art apparatuses.

The first noted object is achieved according to the present invention by an apparatus for the continuous crimping of thermoplastic threads having a crimping nozzle which in turn has a feed channel and a nozzle orifice; a rotary plug feeder having at least one pair of interrupted, lateral means for guiding; the crimping nozzle projecting between the guide means; and protective rings extending around the circumference of the plug feed roller, on either side of the guide means pair, said protective rings also being spaced from and parallel to the guide means.

The second noted object is achieved by the previously noted apparatus wherein the protective rings have the same or a larger external diameter than the guide means.

Specifically, the plug feed roller takes the form of a needle roller and the guide means takes the form of at least one pair of needle rows. Preferably, several guide means pairs are provided on the same plug feed roller in an axially spaced manner and a protective ring is provided between two pairs of guide means, with the protective ring being equidistantly spaced from both the guide means pairs.

In particular, each guide means pair is positioned on a separate carrier ring which has an extension in the axial direction that is greater than the axial extension of the guide means pair. In addition, the protective rings between two guide means pairs are twice as thick as the outer or remaining protective rings or comprise two of the remaining rings.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
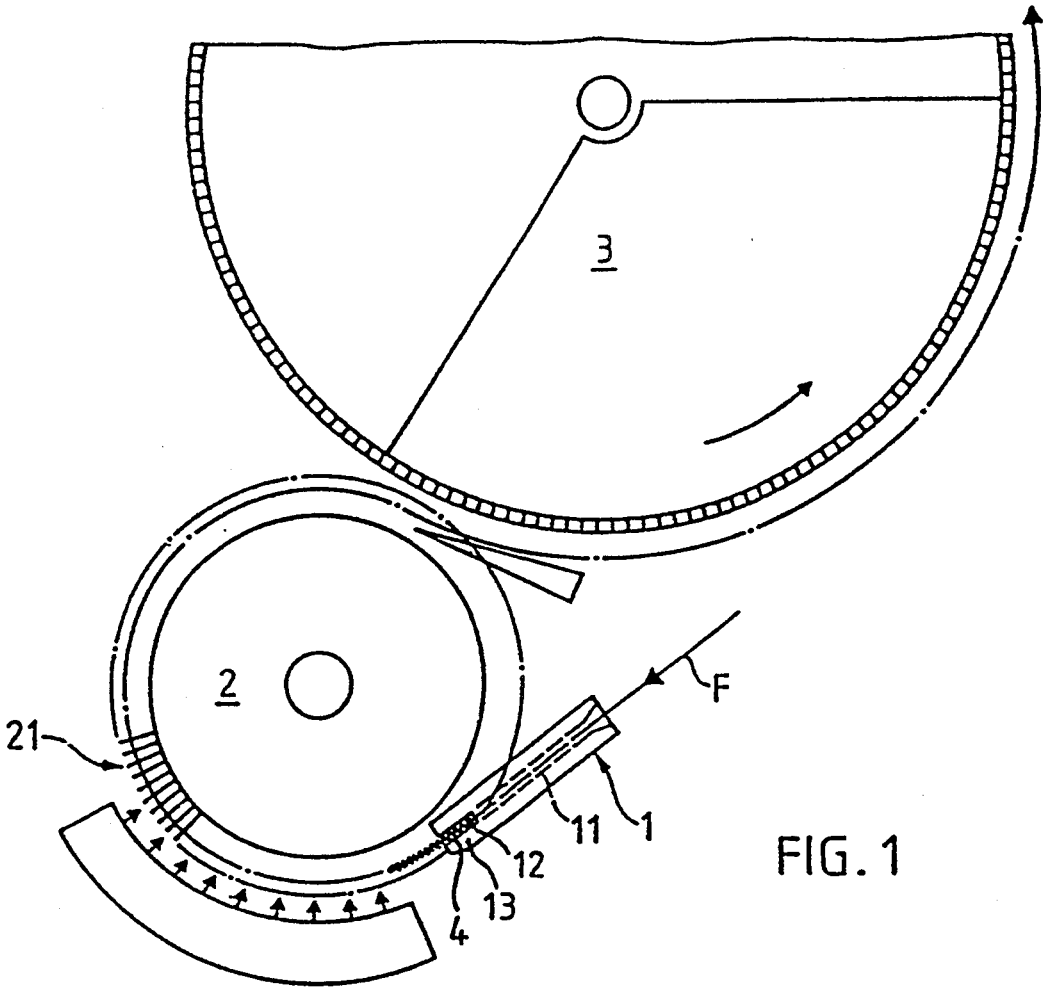
FIG. 1 diagrammatically shows an apparatus for the continuous crimping of thermoplastic threads viewed parallel to the needle roller axis.

FIG. 1 diagrammatically shows an apparatus for the continuous crimping of thermoplastic threads. It has a crimping nozzle 1 with a feed channel 11 and a nozzle orifice 12; a needle roller 2 with at least one pair of needle rows 21; and a cooling roller 3. The crimping nozzle 1 is positioned in such a way that the feed channel 11, with the nozzle orifice 12, issues or extends tangentially to the needle roller 2 and between the needle rows 21. In the vicinity of nozzle orifice 12 a guide fork 13 is e.g. shaped onto crimping nozzle 1. An upper guide part 41 and a lower guide part 42 of guide fork 13 form a stuffer box 4 together with needle rows 21.

Figure 2:
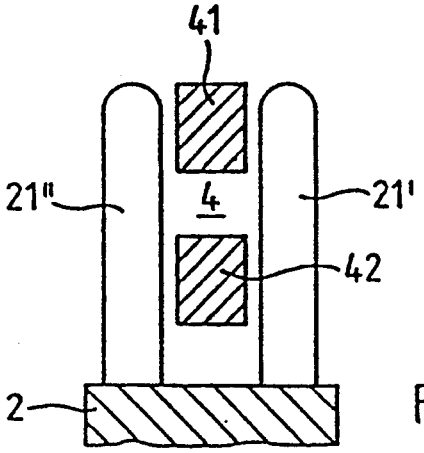
FIG. 2 shows a section through the area of the stuffer box of the apparatus shown in FIG. 1 parallel to the needle roller axis.

FIG. 2 shows the detail of stuffer box 4, parallel to the needle roller axis thereof. It is possible to view the arrangement of guide fork 13 and its upper part 41, remote from the needle roller 2, and its lower part 42 facing the needle roller 2 between the two needle rows 21', 21''.

The apparatus according to the invention is constructed in such a way that crimping nozzle 1 and needle roller 2 are movable away from one another in such a manner that needle roller 2 can be removed in the axial direction. Needle roller 2 is constructed in such a way that it can be placed without difficulty on virtually any random support surface, which greatly simplifies its handling, particularly in the heated or hot state. For the replacement of needle roller 2 crimping nozzle 1 is moved out of the area of needle rows 21, needle roller 2 is dismantled, set down, and a replacement roller is fitted. Roller replacement takes place in a minimum amount of time, and, the ease with which the roller can be set down is important, because in operation it is at a high temperature and must be dismantled and set down in this state.

The circumference of needle roller 2 carries the needle rows 21, or other, interrupted, lateral guide members for plug guidance. Needle rollers 2 are very sensitive, i.e. the roller cannot be supported on the needles without damage. Therefore, according to the invention, on either side and outside the needle row pair 21', 21'', needle roller 2 carries, in each case, a protective ring, such as 27.1, 27.2 and 27.3 which is positioned parallel to needle rows 21', 21'' and is spaced therefrom. Unlike the needle rows the protective rings are not interrupted, i.e. they are more stable by being continuous. The protective rings are spaced from the needle rows in such a way that they do not influence the expansion of the feed medium in the vicinity of the stuffer box and have at least an identical or larger external radius as compared with the needle rows, so that the needle roller, if set down with a rotation axis parallel to a support surface, rests on the protective rings and not on the needle rows.

If the needle roller is used for crimping several parallel threads, in that it has a pair of needle rows for each of the threads, then advantageously each needle row pair is separated by a protective ring from the adjacent needle row pairs. A protective ring is also externally provided on the outermost needle row pairs, so that each pair is positioned separately between two protective rings. An additional advantage of this arrangement is that the flows in the individual stuffer boxes, which are particularly due to the expansion of the feed medium immediately outside the nozzle orifice, do not reciprocally influence one another, as is the case in an arrangement without protective rings. If the needle roller has more than two, juxtaposed needle row pairs, the protective rings contribute to ensuring identical conditions in all the stuffer boxes, quite independently of whether a stuffer box has one or two adjacent stuffer boxes.

Figure 3:
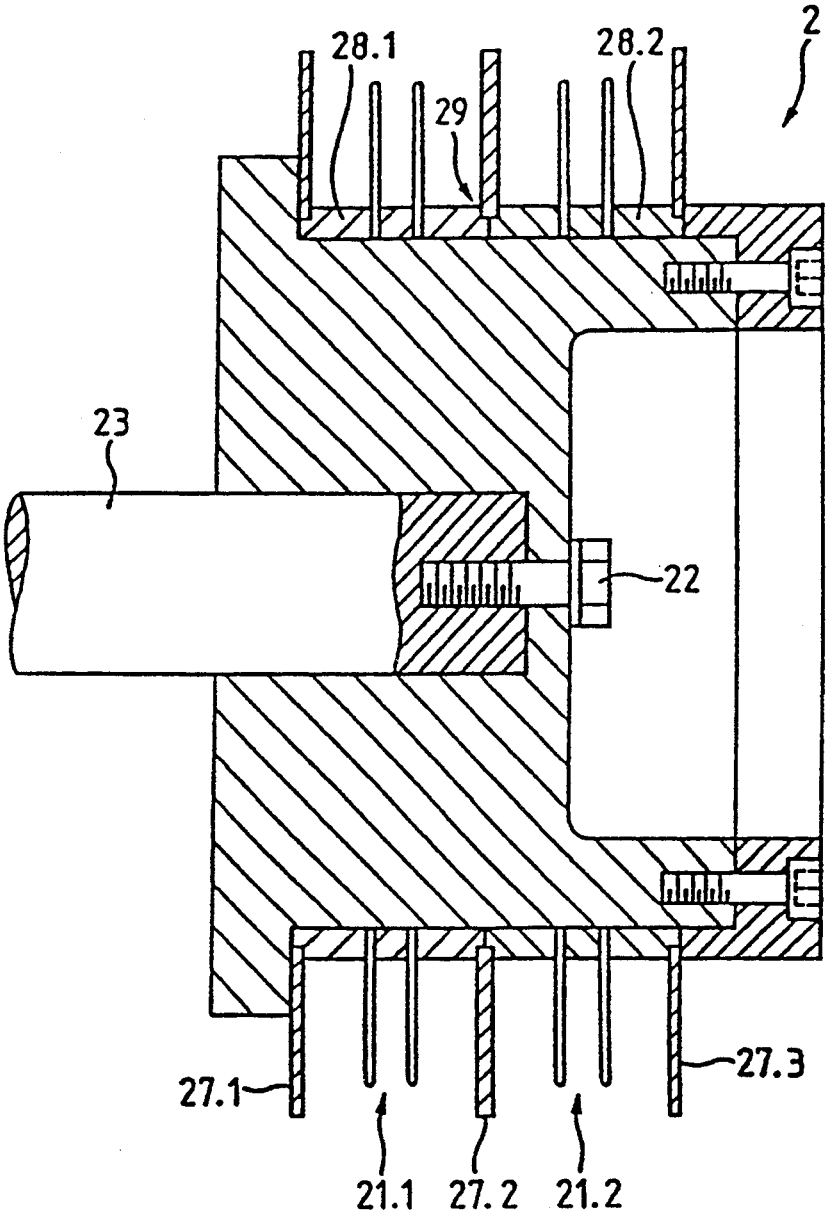
FIG. 3 shows an exemplified embodiment of the needle roller for the apparatus for the continuous crimping of thermoplastic threads according to the invention, sectioned parallel to the rotational axis.

FIG. 3 shows an exemplified embodiment of needle roller 2 for a crimping apparatus according to the invention. Needle roller 2 is e.g. fixed by means of an easily accessible screw 22 to a shaft 23 driving same. Needle roller 2 e.g. carries two pairs of needle rows 21.1 and 21.2. Protective rings 27.1, 27.2 and 27.3 are spaced on either side from a needle row pair with the external diameter of these rings being larger than the external diameter of the needle row pairs 21.1 and 21.2, i.e. projecting over the same by e.g. approximately 1 mm. As a result of the use of protective rings 27.1, 27.2 and 27.3, stuffer boxes 4 are better aerodynamically separated from one another and the needle rows are, during operation, protected against lateral access and, in the dismantled state, the needle roller can be manipulated without any problems.

Advantageously, each of the needle row pairs is fitted to a support or carrier ring 28.1, 28.2, each carrier ring having an axial extension which is greater than that of the needle row pair. As a function of the particular application, several such carrier rings can be juxtaposed in varying numbers. The outer edges of the carrier rings 28.1, 28.2 can be provided with corner grooves 29, into which protective rings 27.1, 27.2 and 27.3 are fitted. In the alternative, the protective rings can be simply provided and fitted as intermediate rings between the carrier rings without corner grooves. In order that carrier rings 28.1, 28.2, with corner grooves 29 can be randomly interchanged, between two such rings it is necessary to use protective rings 27.2 having double the thickness of rings 27.1, 27.3 or two protective rings 27.1 or 27.3, whereas the outer protective rings have but a single thickness or only a single protective ring 27.1, 27.3 is used.

Figure 5:
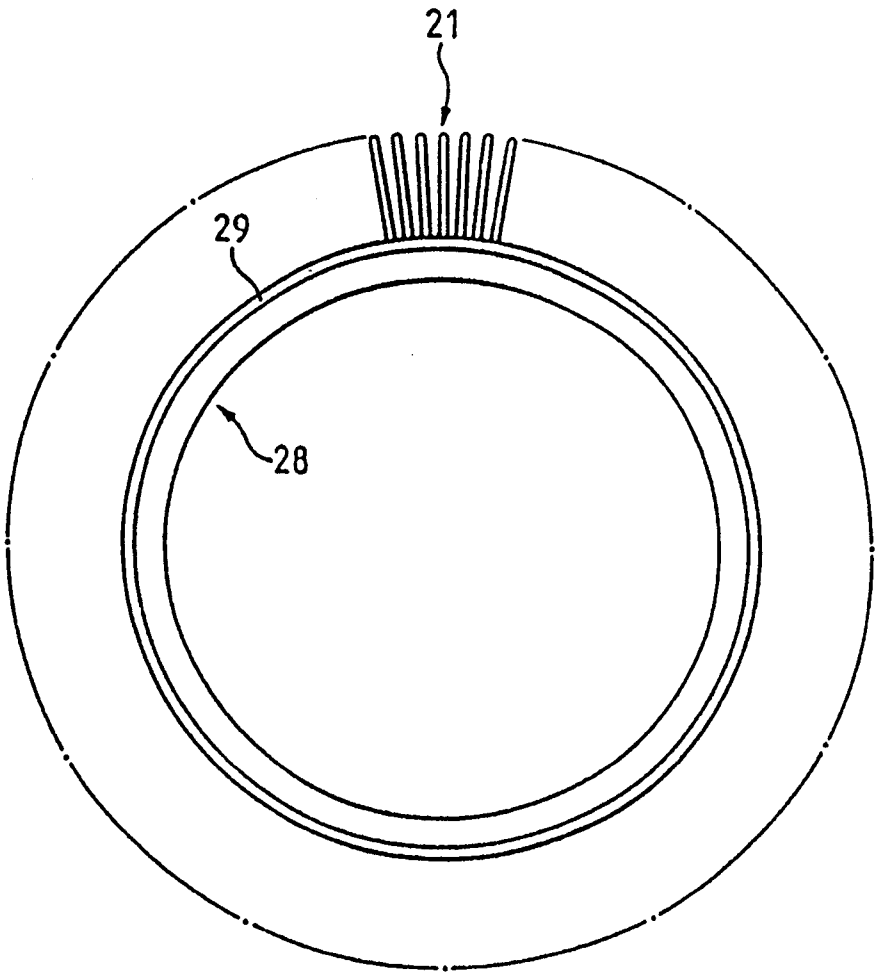
FIG. 5 shows a detail of FIG. 4 viewed parallel to the needle roller axis.
Figure 4:
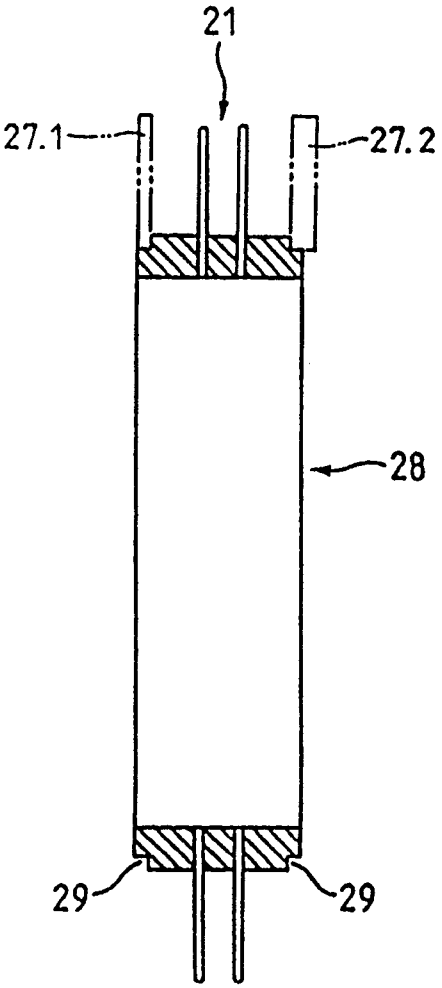
FIG. 4 shows a detail of FIG. 3, in the same section as in FIG. 3.

FIGS. 4 and 5 show the detail of a carrier ring 28 with a needle row pair 21 and corner grooves 29. Dot-dash lines indicate protective rings 27.1 and 27.2, with outer protective ring 27.1 (single thickness) axially terminating the needle roller, while the double thickness protective ring 27.2 constitutes the boundary of the axial area of a needle row pair 21 relative to the area of another needle row pair 21.

As previously noted, the use of protective rings 27 is not limited to plug feed rollers, such as needle rollers, equipped with needle row pairs, but can also be used for protecting other types of interrupted, lateral guide means used with a plug feed roller.

While there are shown and described present preferred embodiments of the invention, it is to be distinctly understood that the invention is not limited thereto, but may be otherwise variously embodied and practiced within the scope of the following claims.

What is claimed is:

1. An apparatus for the continuous crimping of thermoplastic threads comprising in combination:

a crimping nozzle, said crimping nozzle having a feed channel and a nozzle orifice;

a rotary plug feed roller having at least one pair of interrupted laterally spaced means for guiding said plug; said means for guiding having lateral sides; said crimping nozzle projecting between said pair of means for guiding; and protective rings, for protecting said pair of means for guiding, extending around the circumference of said plug feed roller, on the lateral sides of said pair of means for guiding, said protective rings also being spaced from and parallel to said pair of means for guiding.

2. The apparatus of claim 1 wherein said protective rings have an external diameter at least as large as the diameter of said pair of means for guiding.

3. The apparatus of claim 1 wherein said plug feed roller is a needle roller and said pair of means for guiding is at least one pair of needle rows.

4. The apparatus of claim 2 wherein said plug feed roller is a needle roller and said pair of means for guiding is at least one pair of needle rows.

5. The apparatus of claim 1 wherein a plurality of pairs of said means for guiding are provided on the same plug feed roller in an axially spaced manner and that a protective ring is provided between two of said pairs of means for guiding, said protective ring being equidistantly spaced from both of said pairs of means for guiding.

6. The apparatus of claim 1 wherein a plurality of pairs of said means for guiding are provided on the same plug feed roller in an axially spaced manner and that a protective ring is provided between two of said pairs of means for guiding, said protective ring being equidistantly spaced from both of said pairs of means for guiding.

7. The apparatus of claim 3 wherein a plurality of pairs of said means for guiding are provided on the same plug feed roller in an axially spaced manner and that a protective ring is provided between two of said pairs of means for guiding, said protective ring being equidistantly spaced from both of said pairs of means for guiding.

8. The apparatus of claim 1 wherein each of said pair of said means for guiding is positioned on a separate carrier, said carrier ring having an extension in an axial direction that is greater than an axial extension of said pair of means for guiding, and that said plug feed roller comprises at least two of said separate carrier rings.

9. The apparatus of claim 2 wherein each of said pair of said means for guiding is positioned on a separate carrier, said carrier ring having an extension in an axial direction that is greater than an axial extension of said pair of means for guiding, and that said plug feed roller comprises at least two of said separate carrier rings.

10. The apparatus of claim 3 wherein each of said pair of said means for guiding is positioned on a separate carrier, said carrier ring having an extension in an axial direction that is greater than an axial extension of said pair of means for guiding, and that said plug feed roller comprises at least two of said separate carrier rings.

11. The apparatus of claim 4 wherein each of said pair of said means for guiding is positioned on a separate carrier, said carrier ring having an extension in an axial direction that is greater than an axial extension of said pair of means for guiding, and that said plug feed roller comprises at least two of said separate carrier rings.

12. The apparatus of claim 1 wherein the protective rings between two of said pairs of means for guiding are twice as thick as remaining ones of said protective rings.

13. The apparatus of claim 2 wherein the protective rings between two of said pairs of means for guiding are twice as thick as remaining ones of said protective rings.

14. The apparatus of claim 3 wherein the protective rings between two of said pairs of means for guiding are twice as thick as remaining ones of said protective rings.

15. The apparatus of claim 4 wherein the protective rings between two of said pairs of means for guiding are twice as thick as remaining ones of said protective rings.

16. The apparatus of claim 5 wherein the protective rings between two of said pairs of means for guiding are twice as thick as remaining ones of said protective rings.

17. The apparatus of claim 1 wherein the protective rings between two of said pairs of means for guiding comprise two of remaining ones of said protective rings.

18. The apparatus of claim 2 wherein the protective rings between two of said pairs of means for guiding comprise two of remaining ones of said protective rings.

19. The apparatus of claim 3 wherein the protective rings between two of said pairs of means for guiding comprise two of remaining ones of said protective rings.

20. The apparatus of claim 4 wherein the protective rings between two of said pairs of means for guiding comprise two of remaining ones of said protective rings.

21. The apparatus of claim 5 wherein the protective rings between two of said pairs of means for guiding comprise two of remaining ones of said protective rings.

22. The apparatus of claim 6 wherein the protective rings between two of said pairs of means for guiding comprise two of remaining ones of said protective rings.

23. The apparatus of claim 1 wherein said protective rings protect said pair of means for guiding in both a radial and an axial direction.

* * * * *